United States Patent [19]

Stehr

[11] Patent Number: 4,552,525

[45] Date of Patent: Nov. 12, 1985

[54] DIE EJECTOR ASSEMBLY FOR MULTI-STAGE FORMING MACHINES

[75] Inventor: Franz Stehr, Bergisch-Gladbach, Fed. Rep. of Germany

[73] Assignee: Eumuco Aktiengesellschaft fur Maschinenbau, Leverkusen, Fed. Rep. of Germany

[21] Appl. No.: 621,552

[22] Filed: Jun. 18, 1984

[30] Foreign Application Priority Data

Jun. 25, 1983 [DE] Fed. Rep. of Germany ..... 3322944

[51] Int. Cl.[4] ..... B29C 7/00; B29F 1/14

[52] U.S. Cl. ..... 425/422; 72/427; 164/347; 425/556

[58] Field of Search ..... 425/422, 444, 554, 556; 164/347; 72/344, 427

[56] References Cited

U.S. PATENT DOCUMENTS

| | | | |
|---|---|---|---|
| Re. 27,562 | 1/1973 | Smith | 425/444 |
| 249,987 | 11/1881 | Potts | 425/422 |
| 1,994,824 | 3/1935 | Kux | 164/347 |
| 2,314,123 | 3/1943 | Butterfield | 72/427 |
| 3,171,144 | 3/1965 | Maistros | 72/427 |
| 3,299,453 | 1/1967 | De Meerendonk | 72/427 |
| 3,561,054 | 2/1971 | Smith | 425/444 |
| 3,604,242 | 9/1971 | Allebach | 72/427 |
| 3,645,658 | 2/1972 | Detroyer | 425/422 |
| 3,722,253 | 3/1973 | Tsuda et al. | 72/427 |
| 3,938,585 | 2/1976 | Rader | 425/444 |

FOREIGN PATENT DOCUMENTS

| | | | |
|---|---|---|---|
| 2502106 | 7/1975 | Fed. Rep. of Germany | 425/444 |
| 2532482 | 10/1977 | Fed. Rep. of Germany | 425/444 |
| 1435150 | 5/1976 | United Kingdom | 425/444 |

*Primary Examiner*—Willard E. Hoag
*Attorney, Agent, or Firm*—Neil F. Markva

[57] ABSTRACT

The die ejector assembly is for multi-stage forming machines having each forming station provided with a die ejector that is separately adjustable as to its extent of lift. The ejector assembly comprises an ejector pin, an ejector lever member and a drive means for the ejector lever member. An intermediate lever member is disposed between the ejector lever member and the drive means therefor. The intermediate lever member is common to several ejector lever members and has adjustable French curves associated with each forming stage. French curves have circular/tangential cam sections. The intermediate lever member includes means for adjusting the position of the cam sections.

8 Claims, 5 Drawing Figures

DIE EJECTOR ASSEMBLY FOR MULTI-STAGE FORMING MACHINES

FIELD OF THE INVENTION

This invention relates to a die ejector assembly for multi-stage forming machines wherein each forming stage includes a die ejector that is adjustable separately with respect to the extent of lift. More particularly, the invention relates to a die ejector including an ejector pin, an ejector lever member and a drive means for the ejector lever member.

BACKGROUND OF THE INVENTION

Frequently, it is necessary to provide each forming stage of a multi-stage forming machine with a die ejector assembly that is adjustable separately as regards the extent of lift.

Such lift adjustment should be made quickly, safely and reproducibly especially with small lot sizes so as to keep the changeover times short while running the multi-stage forming machines. For this reason, fast tool-change systems are also used whereby the individual forming tools are premounted and ready assembled on a so-called fast-change plate. With tool changing, these fast-change plates are inserted into the tool holder. To make insertion possible, the die ejector must be parted in the same shift plane. This parting line must keep its position even during lift adjustment, i.e. the basic ejector position must not be changed.

Prior known constructions have the capacity of lift adjustment but there even the basic position of the ejector pin is changed. This means that the basic position of the ejector pin has to be respectively readjusted by an additional adjustment member. With other known constructions, during lift adjustment the ejection moment changes. In such an instance, this can have a disadvantageous effect on the thermal die loading during semi-cold and hot forming.

PURPOSE OF THE INVENTION

The primary object of the invention is to produce an ejector assembly with which a constant basic position is guaranteed in spite of the lift adjustment capability. The invention is particularly related to the workbench-side ejector (die ejector) of the type described hereinabove.

SUMMARY OF THE INVENTION

As disclosed and claimed herein, the invention is directed to the particular assembly of an ejector lever member and a drive means having an intermediate lever member arranged therebetween. The intermediate lever member is common to several ejector lever members and has adjustable French curves associated with each forming stage of the forming machine.

The French curves made in accordance with this invention are circumferential/tangential cam sections. The cam sections are mounted displaceably on the intermediate lever member which includes adjustment means such as an adjustment screw. The circumferential/tangential cam sections include a straight section and a curved section. During lift adjustment, the ejector lever member is supported only on the straight cam section of the French curve while the basic position of the ejector pin always remains the same.

In accordance with another feature of the invention, a common French curve can be provided as a drive for the individual die ejectors. Thus, the cam plate can be adjustable to the drive shaft with respect to its angular position and can be secured.

A drive means for the individual die ejectors may comprise a piston-cylinder unit flexibly connected to the intermediate lever member. Such drive means are basically for forming machines which are operated by hand or by a manipulator.

With machines operated in the switch operation, the drive means for the constant rotating movement of the intermediate lever member is advantageously derived from the cam shaft or eccentric shaft of the forming machine. Thus, the derived movement can be effected by a cam plate, lever member, connecting rod and a further lever member carrying a ratchet means.

Advantageously, the lever member carrying the ratchet means is acted on by a cylinder whereby the ratchet means is positively connected to the lever only in one direction and is freely rotatable in the other direction. The latter type assembly is used particularly for holding the ejector pin in the top ejector position right up to the time the workpiece is removed from the forming machine.

ADVANTAGES OF THE INVENTION

Several essential advantages result from such a construction of a die ejector assembly made in accordance with the invention. An individual lift adjustability is achieved without the basic position common to all of the ejector pins being effected by it. Thus, there is a considerable simplification in the tool-changing procedure. The lift adjustability can be carried out with only one adjustment member.

The die ejector assembly of this invention is very simple to maneuver. Reproducibility of operation is guaranteed through the possibility of a clear display. The ejector assembly of the invention has a very simple construction. Even though the adjustability of each individual forming station is possible, there is only one common drive means required. Through the common intermediate lever member, the beginning of the ejection and the end of the ejection for all predetermined extents of lift is always at the same moment. Thus, an optimum adaptation to the automatic cross transport is achieved.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
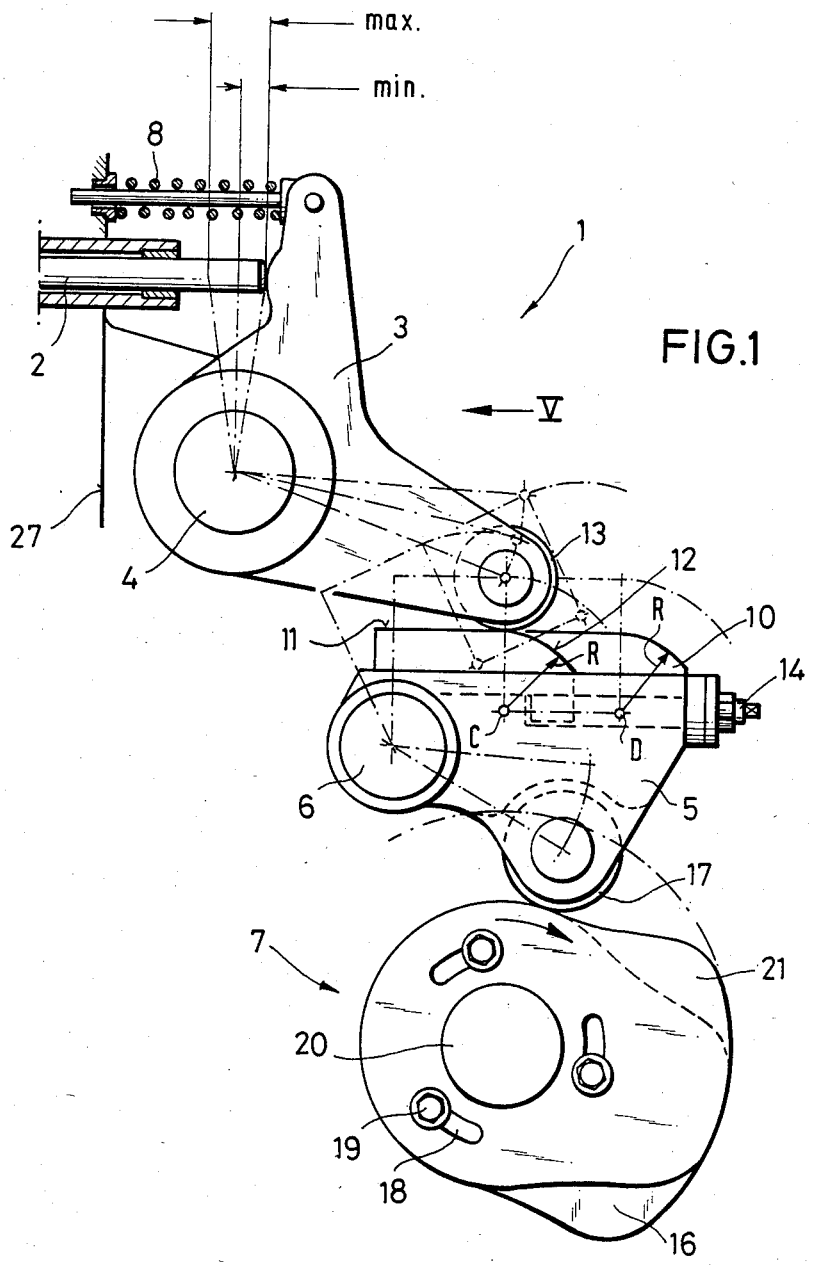
FIG. 1 is an elevational side view partially in section of an embodiment of a die ejector device for multistage forming machines made in accordance with the invention.

The die ejector assembly, generally designated 1, includes an adjustable lift for forming machines. Each forming stage has a separately adjustable ejector lift for the forming machine. Die ejector assembly 1 includes an ejector pin 2, an ejector lever member 3 rotatably mounted on shaft 4, an intermediate lever member 5 rotatably mounted on a shaft 6, and a drive device, generally designated 7. Ejector lever member 3 is acted upon by a return spring 8.

Intermediate lever member 5 is common to several ejector lever members 3 and includes French curves 10 which are associated with each forming stage of the forming machine to which the assembly 1 is operational. French curves 10 have circular/tangential cams which have a straight line section 11 with an adjacent circular section 12 of a radius R.

Ejector lever member 3 abuts cam surface sections 11 and 12 of the French curves 10 with a roller member 13. French curves or cam surfaces 10 are arranged adjustably on the common intermediate lever member 5. The French curves or cam surfaces 10 are displaceably mounted on lever member 5 and adjusted with the adjusting screws 14. The adjustment path for the French curves 10 stretches over the distance from C to D. The increase in lift is due to an adjustment of the French curve in the direction C to D. Thus, the desired lift can be read directly on a scale (not shown). With lift adjustment, roller member 13 of lever member 3 is supported only on the straight part of French curves 10. Thus, the basic position of ejector pin 2 is maintained in the same position. According to the adjustment of French curves 10 between points C and D, roller members 13 of the individual ejector lever members 3 are driven with different pivoting (rotating) angles, which are at the same time the drive pivoting (rotating) angles for ejector pins 2. In other words, there are a plurality of pins and an assembly as discussed here for each one of the pins that are present to operate the lift for the forming machine to which the assembly 1 is associated.

A single drive assembly, generally designated 7, is sufficient for driving the individual combination of an ejector pin 2, ejector lever member 3 and intermediate lever member 5. As shown in FIG. 1, drive assembly 7 comprises a common cam plate 16.

Cam plate 16 is driven by the forming machine with synchronous speed to drive the ejector assembly. Cam plate 16 acts on the common intermediate lever member 5. The individual French curves or cam surfaces 10 with the associated adjusting spindles 14 are disposed on intermediate lever member 5 at a distance from the forming tools (not shown).

Intermediate lever member 5 is driven with a constant pivoting angle of desired dimension by a structurally determined lift of cam plate 16. Ejector lifts can be easily adapted (to the respectively required ejector lift limit) by the layout of cam plate 16 and by changing the effective lever ratios (of the respectively required ejector lift limit). To reduce the thermal die loading, the beginning of the ejector lift should preferably follow directly after the return spring action of the forming machine. The ejection beginning and the ejection end for all the set lift extents is always at the same time via the common intermediate lever member 5. The ejector lift movement with all lifts (apart from the minimum lift) coincides until roller member 13 of ejector lever members 3 leaves the straight cam section 11 of French curve 10 thereby making it possible to achieve a good adaptation to the ram (push rod) ejector (not shown).

Drive cam plate 16 may be rotated by splined shaft cogging or circumferential stress elements. In co-ordination with the push rod-side ejector lift, by rotating drive cam plate 16 in simple fashion, the beginning of lift of die ejector pin 2 can be deferred or shifted. It may be necessary to adapt to the automatic cross transport such as during the takeover time by the gripper devices of the forming machine. To effect such an adaptation, the lengths of the stop (ejector in highest position) can be adjusted by rotating the unloaded return stroke cam 21 of the drive cam plate 16. The adjustment of cam 21 is effected by loosening locking screws 19 within slots 18.

Figure 2:
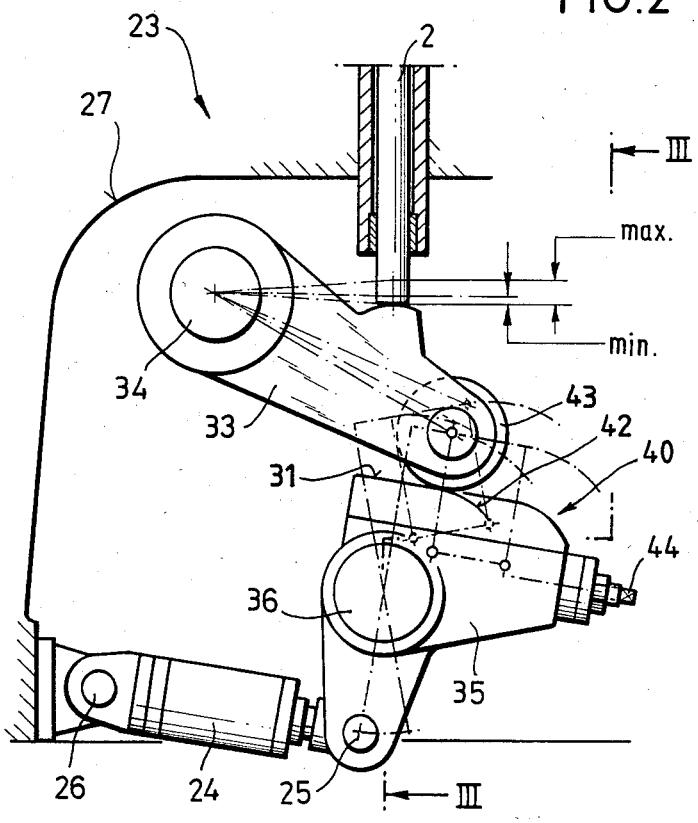
FIG. 2 is a side elevational view partly in section of another embodiment of a die ejector device made in accordance with this invention.
Figure 3:
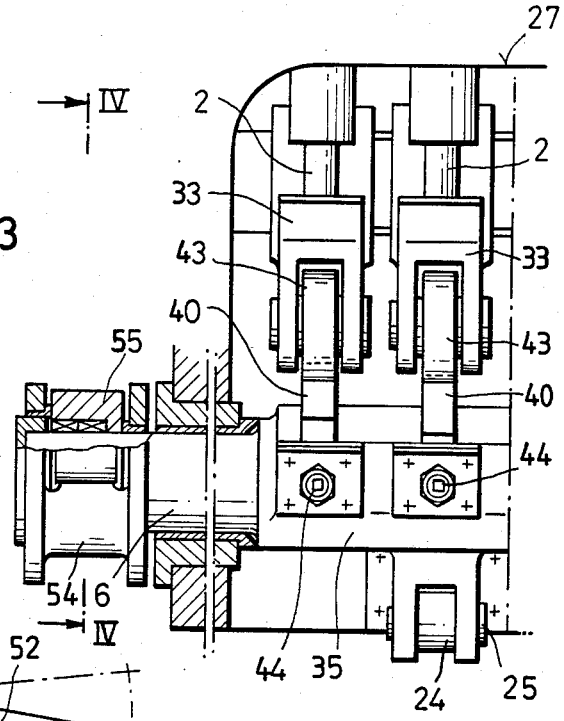
FIG. 3 is a sectional view along line III—III of FIG. 2 taking into account the fact that the machine is operated in the switch operation.

FIG. 2 shows a further embodiment of a die ejector assembly, generally designated 23, corresponding substantially to the earlier embodiment of die ejector assembly 1. In this embodiment, a hydraulic cylinder 24 is pivotally mounted at one end thereof on intermediate lever member 35 at pivot point 25 and at the other end thereof at pivot point 26 located on machine housing 27. Thus, hydraulic cylinder 24 in this embodiment is used as a driving device instead of the drive cam plate or curve 16 as in the previous embodiment. A lift for ejector pin 2 is adjusted from a minimum to a maximum through adjustment of French curves 40 without the basic position of the common intermediate lever member 35 being changed. The various adjustment positions of intermediate lever member 35 are shown via the dash-dot lines of FIG. 2.

Figure 4:
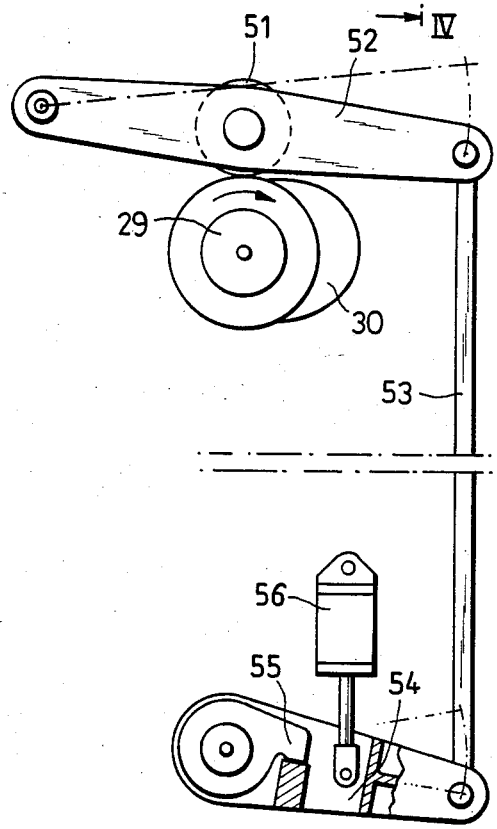
FIG. 4 is a sectional view along line IV—IV of FIG. 3 of the device as shown in FIG. 3.
Figure 5:
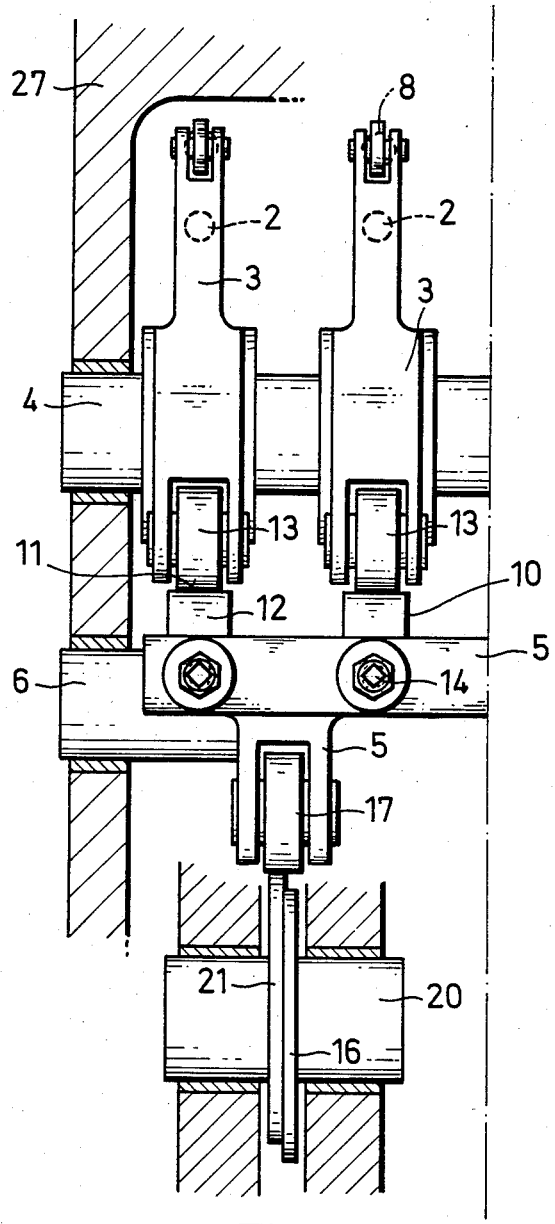
FIG. 5 is a sectional view along the arrow V of FIG. 1.

Some forming machines are noncontinuous and operate in a switch operation or noncontinuous working method. In such a noncontinuous forming machine, the constant pivoting or rotating movement of intermediate lever member 5 or 35 can be derived from a cam shaft or eccentric shaft 29 of the noncontinuous forming machine. See FIG. 4 for this type of drive mechanism. The cam plate 30 located on cam shaft or eccentric shaft 29, roller member 51, lever member 32, connecting rod 53, a further lever member 54 and ratchet member 55 comprise an assembly used to achieve the constant pivoting or rotating movement of intermediate lever member 35 of this embodiment.

To remove workpieces by hand or by automatic cross transport, air cylinder 24 is used to hold ejector pin 2 in the top ejector position until the time when the workpieces are removed. Ratchet 55 is secured on one end of intermediate lever member 35 by circumferential stress elements. So that the initial stressing force for the cam drive, produced by cylinder 56, does not have to be overcome during high level operation, ratchet 55 is connected positively in only one direction to the other lever member 54 and in the other direction is freely rotatable.

While the die ejector assembly for multi-stage forming machines has been shown and described in detail, it is obvious that this machine is not to be considered as limited to the exact form disclosed, and that changes in detail and construction may be made therein within the scope of the invention without departing from the spirit thereof.

Having thus set forth and disclosed the nature of the invention, what is claimed is:

1. An ejector assembly for a multi-stage forming machine having each forming stage including a die ejector that is separately adjustable as to its extent of lift, said assembly comprising:

(a) an ejector pin, an ejector lever member and a drive means for the ejector lever member, (b) an intermediate lever member disposed between the ejector lever member and the drive means, (c) said intermediate lever member being common to several ejector lever members, (d) said intermediate lever member having adjustable able French curve cam surfaces for each forming stage of the forming machine.

2. An assembly as defined in claim 1 wherein the French curves include circular/tangential cam sections, and the intermediate lever member includes means for adjusting the position of the cam sections.

3. An assembly as defined in claim 2 wherein the cam sections are displaceably mounted on the intermediate lever member, and the adjusting means includes a threaded spindle.

4. An assembly as defined in claim 1 wherein there is an ejector pin at each forming station and an individual die ejector member for each ejector pin, and die ejector drive means said drive means includes a common cam plate and a drive shaft, the cam plate is arranged adjustably to the drive shaft in an angular position.

5. An assembly as defined in claim 1 wherein there is an ejector pin at each forming station and an individual die ejector member for each ejector pin, and the drive means includes a piston-cylinder unit flexibly connected to the intermediate lever member.

6. An assembly as defined in claim 1 wherein the forming machine is driven in a noncontinuous working method and includes a crankshaft or eccentric shaft, said drive means is effective to drive the intermediate lever member in a constant, rotating movement, said drive being derived from the crankshaft or eccentric shaft of said forming machine.

7. An assembly as defined in claim 6 wherein the derived movement for the intermediate lever member is effected by drive means which include a cam plate, a roller member, a lever member, a connecting rod, and a lever member carrying ratchet means.

8. An assembly as defined in claim 7 wherein the lever member carrying the ratchet means is acted on by a cylinder, and the ratchet means is connected to the lever member which carries it in a positive manner only in one direction and is freely rotatable in the other direction.

* * * * *